US008727253B2

(12) United States Patent
Smith

(10) Patent No.: US 8,727,253 B2
(45) Date of Patent: May 20, 2014

(54) THREE ROLL MILL

(75) Inventor: Kenneth Malcolm Smith, East Brent (GB)

(73) Assignee: Jeffrey P. Smith, Toronto, Ontario (CA)

( * ) Notice: Subject to any disclaimer, the term of this patent is extended or adjusted under 35 U.S.C. 154(b) by 475 days.

(21) Appl. No.: 13/065,503

(22) Filed: Mar. 23, 2011

(65) Prior Publication Data

US 2011/0233315 A1 Sep. 29, 2011

Related U.S. Application Data

(60) Provisional application No. 61/341,013, filed on Mar. 25, 2010.

(51) Int. Cl.
*B02C 9/04* (2006.01)

(52) U.S. Cl.
USPC ..... 241/152.1; 241/157

(58) Field of Classification Search
USPC ..... 241/152.1, 157, 235, 237, 238, 16, 239, 241/285.1, 285.2; 83/12, 22; 72/237, 238, 72/247, 248, 249, 239; 100/161, 162 R, 100/163 R, 164, 165, 163 A, 168, 169, 170, 100/171
See application file for complete search history.

(56) References Cited

U.S. PATENT DOCUMENTS

| | | | | | |
|---|---|---|---|---|---|
| 2,063,363 | A * | 12/1936 | Brasington | 241/226 |
| 2,254,512 | A * | 9/1941 | Brasington | 241/111 |
| 2,694,268 | A * | 11/1954 | Dornbusch | 38/44 |
| 3,372,878 | A * | 3/1968 | Verdier | 241/16 |
| 3,869,983 | A * | 3/1975 | Garber et al. | 101/137 |
| 4,173,492 | A * | 11/1979 | Pollard | 106/415 |
| 5,336,076 | A * | 8/1994 | Waldherr et al. | 425/294 |
| 5,460,119 | A * | 10/1995 | Maroszek | 118/244 |
| 5,735,157 | A * | 4/1998 | Yamamoto et al. | 72/164 |
| 5,782,126 | A * | 7/1998 | Drigani et al. | 72/239 |
| 6,082,924 | A * | 7/2000 | Seidl et al. | 403/365 |
| 6,308,547 | B1 * | 10/2001 | Heess et al. | 72/107 |
| 7,953,352 | B2 * | 5/2011 | Dobbertin et al. | 399/274 |

* cited by examiner

*Primary Examiner* — Shelley Self
*Assistant Examiner* — Homer Boyer
(74) *Attorney, Agent, or Firm* — F. Brice Faller

(57) ABSTRACT

A three roll mill having a feed roll, a center roll, and an apron roll with that are driven so that their cylindrical surfaces move in the same direction but different speeds in each nip. One end of each roll is engaged by a drive shaft at a first side of the mill, whereas the other end of each roll rotates freely at a second side of the mill. Each roll can be removed individually and without tools by moving the roll away from the first side against a spring force in the second side. This disengages the roll from its drive shaft, whereupon it can be lifted out of the mill.

18 Claims, 7 Drawing Sheets

IDLE SIDE

THREE ROLL MILL

FIELD OF THE INVENTION

The invention relates to a grinding mill of the type having parallel rolls driven at different speeds so that granular material fed into the nip between adjacent rolls is subjected to both crushing and shear forces. More particularly, it relates to a three roll ointment mill wherein a paste fed into the nip between a feed roll and a center roll is carried by the center roll to the nip formed by the center roll and an apron roll, where it is picked up by the apron roll and removed by a scraper.

DESCRIPTION OF THE RELATED ART

Ointment mills are well known to pharmacists. U.S. Pat. No. 915,864 (1909) discloses an ointment mill having a pair of rolls mounted for rotation between a pair of parallel frame members. A first roll is rotated by a hand crank at one end, and a second roll is rotated by a pair of intermeshing gears at the other end. The gears are sized so that that the second roll rotates about three times as fast as the first roll. Since the surface speeds of the rolls are different, particulate in a paste fed into the nip between rolls is subjected to shear force. The second roll is carried in journal boxes that are spring-loaded toward the first roll to provide crushing force. The combination of forces yields an ointment with very fine particulate.

Modern ointment mills typically have three rolls, so that the particulate is subjected to a second grinding step before the paste is removed by a scraper or doctor blade. One such ointment mill is manufactured by Exakt Vertriebs GmbH of Norderstedt, Germany. The Exakt Model 50 is a three roll mill wherein paste is fed downward between a feed roll and a center roll, whose surfaces in the nip are moving in the same direction at different speeds. The paste adheres to the faster center roll, and is carried upward between the center roll and an apron roll, whose surfaces in the nip are moving in the same direction at different speeds. Unlike the mills of a century ago, modern rolls are not spring loaded to provide compressive force. Rather, the gaps between rolls are adjusted by pivoting plates on which the feed and apron rolls are mounted. However the rolls are still mounted for rotation between a pair of parallel frame members, wherein the apron roll is driven at one end, and the other rolls are driven by intermeshing gears at the other end. The Exakt machine employs pulleys driven by cog belts to drive the apron roll through a two-stage speed reduction from a motor mounted between the frame members at the bottom of the unit. The apron roll, in turn, drives a center roll and a feed roll via intermeshing gears that step down the rotational speed.

When the rolls need to be removed from the frame members, the cog belts and pulleys must first be removed from the one end, followed by the three gears on the other ends of the roll shafts. This is followed by removal of feathering keys, circlips, and bearing plates from the gear ends, and removal of tensioning springs and bearing plates on the pulley ends. The frame members on both ends must be separated so that the feed and apron rolls can be lifted out as a unit with the pivot plates. Finally, the pivot plates must be removed.

In an effort to make the task of cleaning rolls easier, Exakt has introduced the Model 50 Easy Clean, wherein the rolls are mounted in a subframe that can be removed as a unit for cleaning. However it is still not easy to remove the individual rolls.

Other manufacturers of three roll mills include Torrey Hills Technologies, Mikrons, and Charles Ross & Son Co. All have websites where their machines can be seen. None offers easy removal of rolls.

From the foregoing it will be apparent that removal of the rolls for cleaning requires a number of different tools and is very time-consuming. Indeed, it is an operation that many users would rather not undertake at all. However frequent cleaning is necessary to maintain the high standards of purity required in pharmaceutical preparations.

SUMMARY OF THE INVENTION

An object of the invention is to provide a three roll mill, in particular an ointment mill, wherein the rolls may be removed quickly and easily without any tools.

Another object is to provide a roll drive and differential speed arrangement that is arranged wholly at one end of the rolls, so that the other ends may rotate freely. The three roll mill according to the invention includes a frame having first and second spaced apart support structures in the form of chassis plates, and parallel rolls including a feed roll, a center roll, and an apron roll mounted between the chassis plates. Pulleys are fixed to drive shafts mounted for rotation in the first support structure and fixed against rotation relative to respective rolls by axially releasable connections. Axially movable pins at the second chassis plate are received coaxially in respective rolls, whereby the connections at the first end wall can be released by moving the rolls axially against the pins. These pins are preferably spring-loaded toward the first support structure.

The pulleys have progressively smaller effective diameters so that a common drive belt will drive the successive rolls at progressively higher speeds. The drive belt is driven by a drive pulley that, in turn, is driven by a motor pulley though a speed reducing arrangement.

The drive shafts for the feed and apron rolls are mounted for rotation in bearings fixed to pivot plates that are pivotably mounted on the first chassis plate. The drive shaft for the center roll rotates in a fixed plate, so that the two gaps can be adjusted by moving the pivot plates. Likewise, the axially movable pins for the feed and apron rolls are mounted for axial movement in sleeves fixed to pivot plates that are pivotably mounted on the second chassis plate, whereas the axially movable pin for the center roll is mounted for axial movement in a fixed sleeve. The gaps can thus be adjusted at both ends and made uniform along their lengths.

According to a preferred embodiment, each axially releasable connection is formed by a drive plate fixed to the respective drive shaft, means for centering the roll coaxially with respect to the drive plate, an offset pin fixed to the roll, and a radially extending slot in the drive plate, the pin being received in the slot to prevent relative rotation.

The coaxial pins at the second chassis plate preferably have conical tips received in coaxially arranged conical recesses in respective rolls. This acts as a simple bearing arrangement that permits the rolls to rotate relative to the pins.

BRIEF DESCRIPTION OF THE DRAWING

FIG. 8 is an end view of the scraper mechanism for the apron roll.

DETAILED DESCRIPTION OF THE PREFERRED EMBODIMENT

Figure 1:
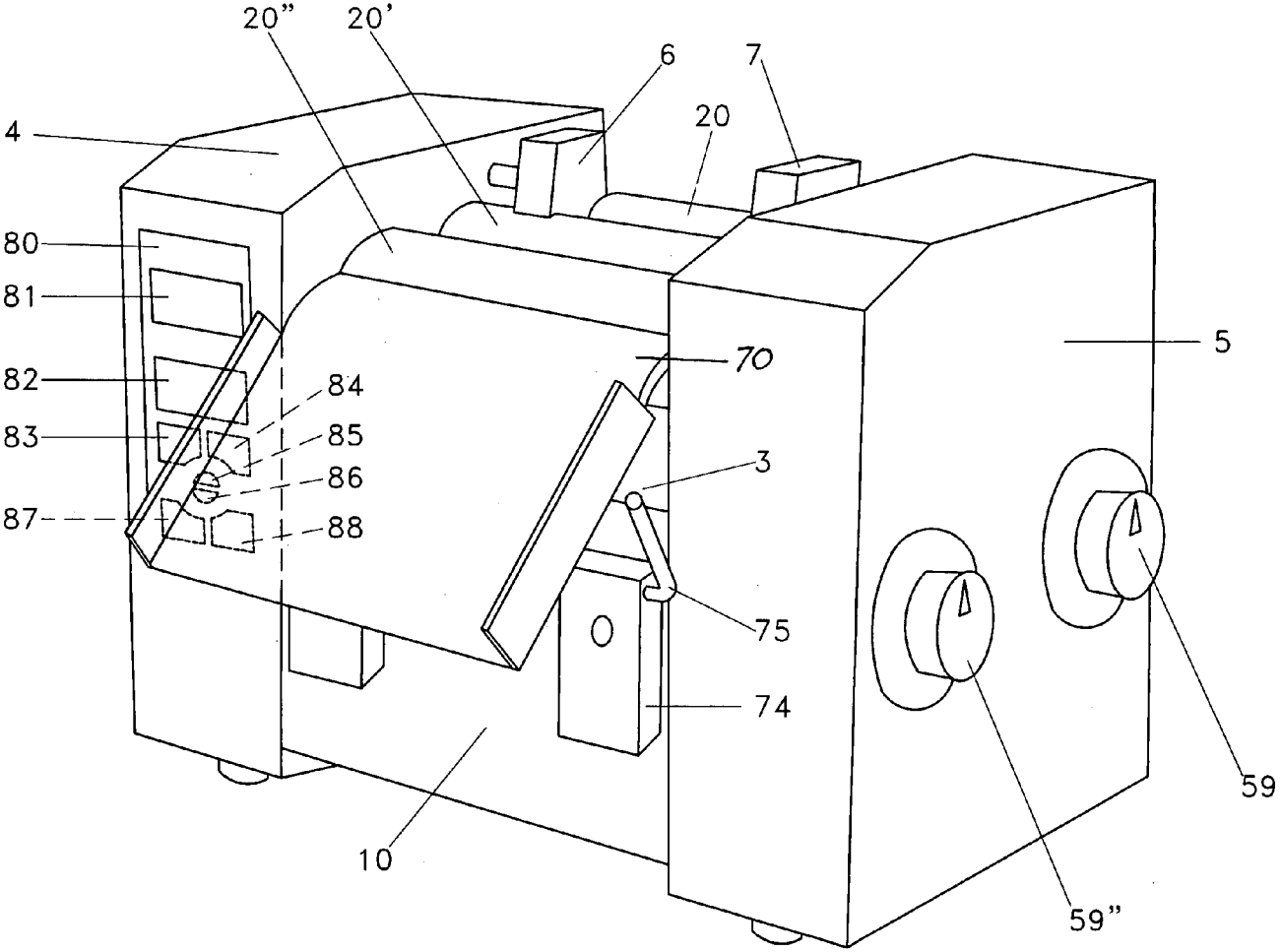
FIG. 1 is a perspective view of a three roll mill according to the invention, showing the rolls, scraper, and control panel.

Since the mounting arrangement for the rolls is substantially identical, components associated with respective rolls will utilize the same reference numerals. Those associated with the feed roll will be unprimed, whereas those associated with the center roll will have a single prime, and those associated with the apron roll will have a double prime.

FIG. 1 shows the three roll mill with the left side cover 4, right side cover 5 and scraper 70 in place on box frame 10. The feed roll 20, center roll 20', and apron roll 20" are exposed as in other three roll mills. A pair of spring-loaded guide blocks 6, 7 extend closely into the nip between the feed and center rolls to prevent the escape of material from the ends of the rolls. These are well known and will not be shown again. A platform 3 catches any material that falls off the rolls, and can be easily removed for cleaning. Knobs 59, 59" are used to control the gaps between rolls, as will be described. Finished ointment is removed from apron roll 20" by scraper 70 which can be tilted using handle 75 mounted in support block 74.

A control panel 80 is used to control the roll speed, time, and direction of rotation. The panel 80 includes a timer 81, speed display 82, run switch 83, stop switch 84, speed increase switch 85, speed decrease switch 86, timer reset 87, and roller reverse switch 88. These controls and the attendant wiring are conventional and will not be described further.

Figure 2:
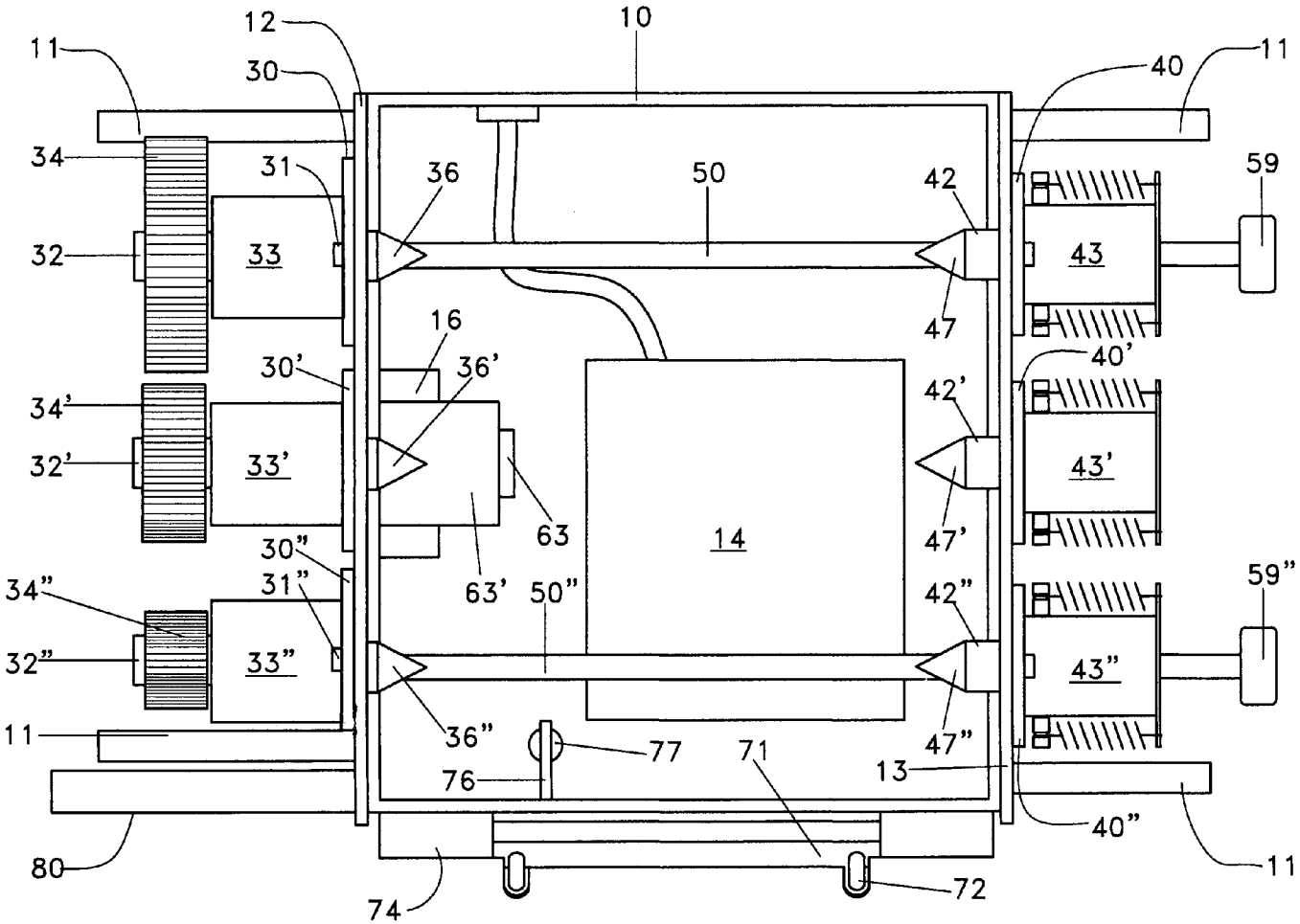
FIG. 2 is a plan view of the mill with the side covers and rolls removed.
Figure 6:
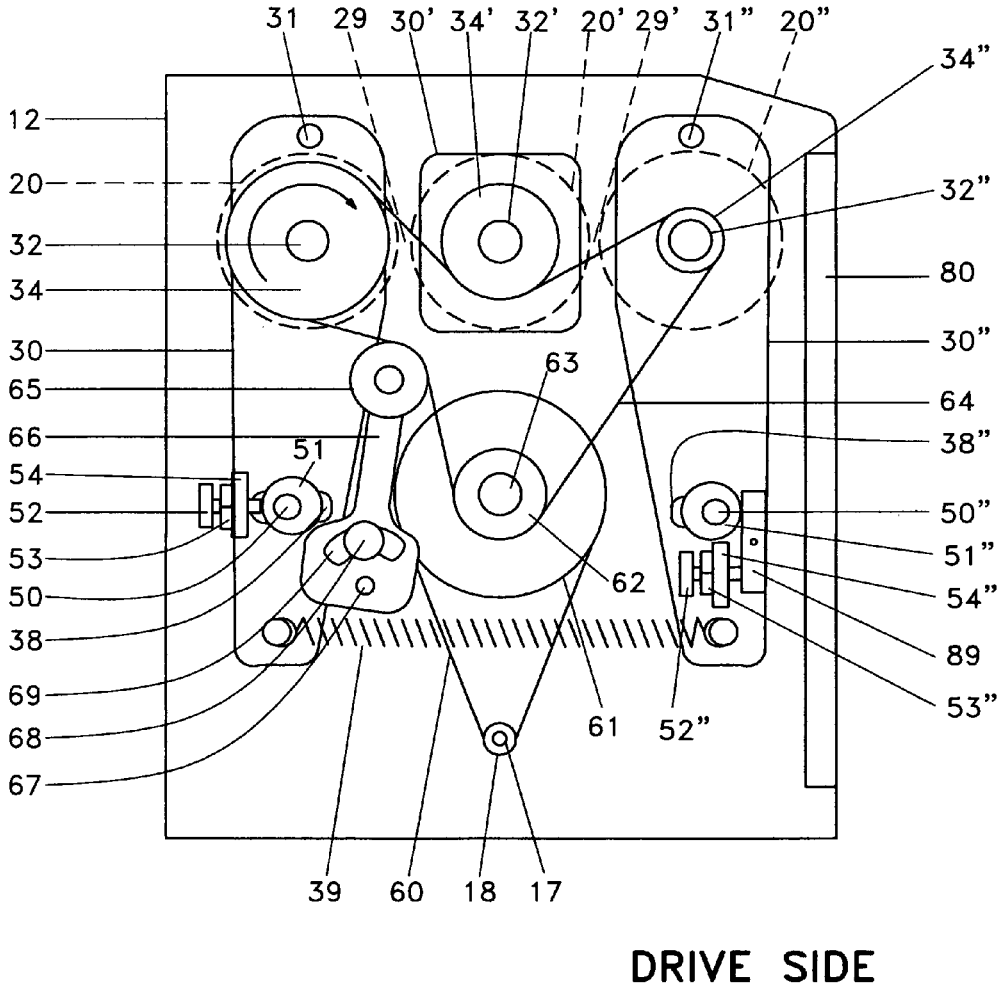
FIG. 6 is an end view showing the drive arrangement for the rolls.

FIG. 2 is a plan view showing the inside of the frame with the rolls and platform removed. The basic support structure is a box frame 10 to which a first chassis plate 12 and a second chassis plate 13 are fixed on opposite sides. Four posts 11 are fixed to each of plates 12, 13 for mounting side covers 4, 5 (FIG. 1). AC power is provided to a power supply 14 that rectifies it for DC motor 16 that drives pulleys 34, 34', 34" via cog belts 60, 64 (FIG. 6). Control panel 80 can be used to regulate the current, and thus the RPM, as well as the polarity, and thus the direction of rotation. The motor is preferably a low profile Maxon brushless motor rated for 50 w at 4500 RPM. A shaft 63 journaled in a bearing 63' above the motor 16 carries a pulley arrangement (FIG. 6) that transfers power from the motor 16 to the roll pulleys 34, 34', 34". The drive shafts 32, 32', 32" rotate in bearing housings 33, 33', 33" fixed to plates 30, 30', 30" on the outside of first chassis plate 12. Pulleys 34, 34', 34" are fixed to the outer ends of respective drive shafts, whereas the conical inner ends 36, 36', 36" stand proud of plate 12. Pins 42, 42', 42" are arranged to slide axially in sleeves 43, 43', 43" fixed to plates 40, 40', 40" on the outside of second chassis plate 13, whereas the conical inner ends 47, 47', 47" stand proud of the plate 13. Camshaft 50 is used to pivot plates 30, 40, whereas camshaft 50" is used to pivot plates 30" and 40".

Figure 3:
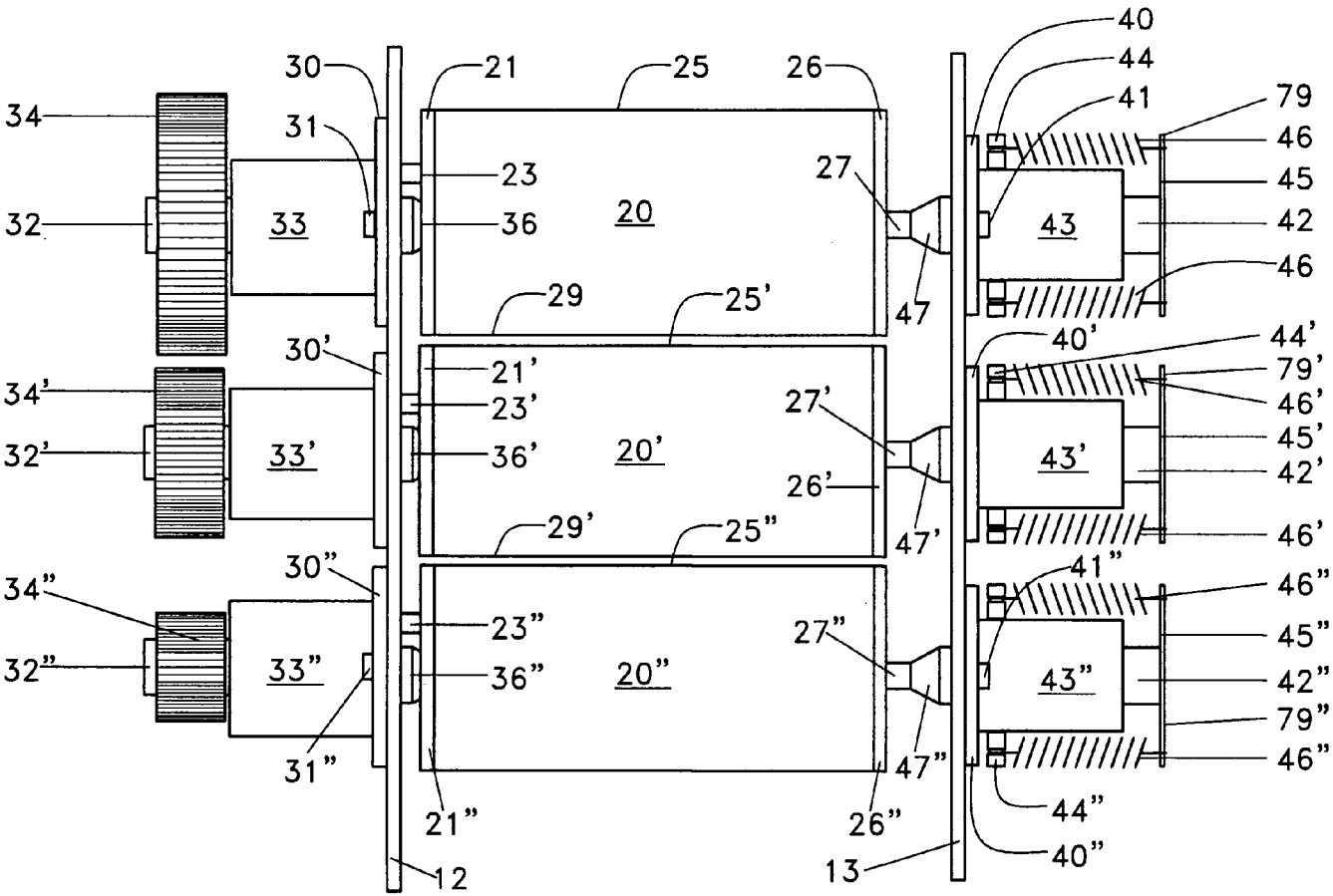
FIG. 3 is a simplified plan view of the rolls and bearings.

FIG. 3 shows the mounting arrangement for the rolls 20, 20', 20". Each roll is formed by a tube that may be made of stainless steel or a ceramic such as porcelain or alumina. The roll 20 has a first end formed by a first end piece 21, and a second end formed a second end piece 26. The end pieces 21, 26 are molded of durable plastic such as polyoxymethylene (POM), also known as acetal. POM is characterized by high strength, hardness, rigidity, and a low coefficient of friction. The end pieces 21, 26 are bonded in the tube to form the complete roll 20 having a cylindrical surface 25. The first end piece 21 has a central conical recess that receives the conical tip 36 of the drive shaft 32, and a radially offset drive pin 23. The second end piece 26 has a steel spigot 27 located centrally and bonded in place; the spigot 27 has a central conical recess that receives the conical tip 47 of axially movable pin 42. The conical recesses are also useful for centering the roll while the cylindrical surface 25 is machined for concentricity with the central axis. This assures a uniform gap between rolls. The gap 29 between rolls 20, 20' and the gap 29' between rolls 20', 20" are adjusted using the camshafts 50, 50" (FIG. 2). Rolls 20' and 20" are identical to and interchangeable with roll 20.

The pin 42 is axially loaded toward the roll 20 by a pair of tension springs 46. This loads the roll 20 toward the first chassis plate 12 so that it rotates with the drive shaft 32. Each spring 46 has one end attached to a stud 44 fixed in sleeve 43, and another end attached to an ear 79 on plate 45 fixed on the outer end of pin 42. The pin 42 is preferably made of polyether ether ketone (PEEK), a semicrystalline thermoplastic with mechanical and chemical resistance properties that are retained to high temperatures. Since the pin 42 does not rotate, this makes it suitable for the bearing surface where the conical tip 47 engages the recess in spigot 27. Each assembly of a drive shaft 32, 32', 32" in a respective bearing housing 33, 33', 33" is identical, but for the diameter of pulleys 34, 34', 34". Each assembly of a pin 42, 42', 42" in a respective sleeve 43, 43', 43" is also identical. In lieu of springs, it is also possible for the axially movable pin 47 to positively engage the roller 20, e.g. by a latch effective between spring plate 45 and sleeve 43.

Figure 4:
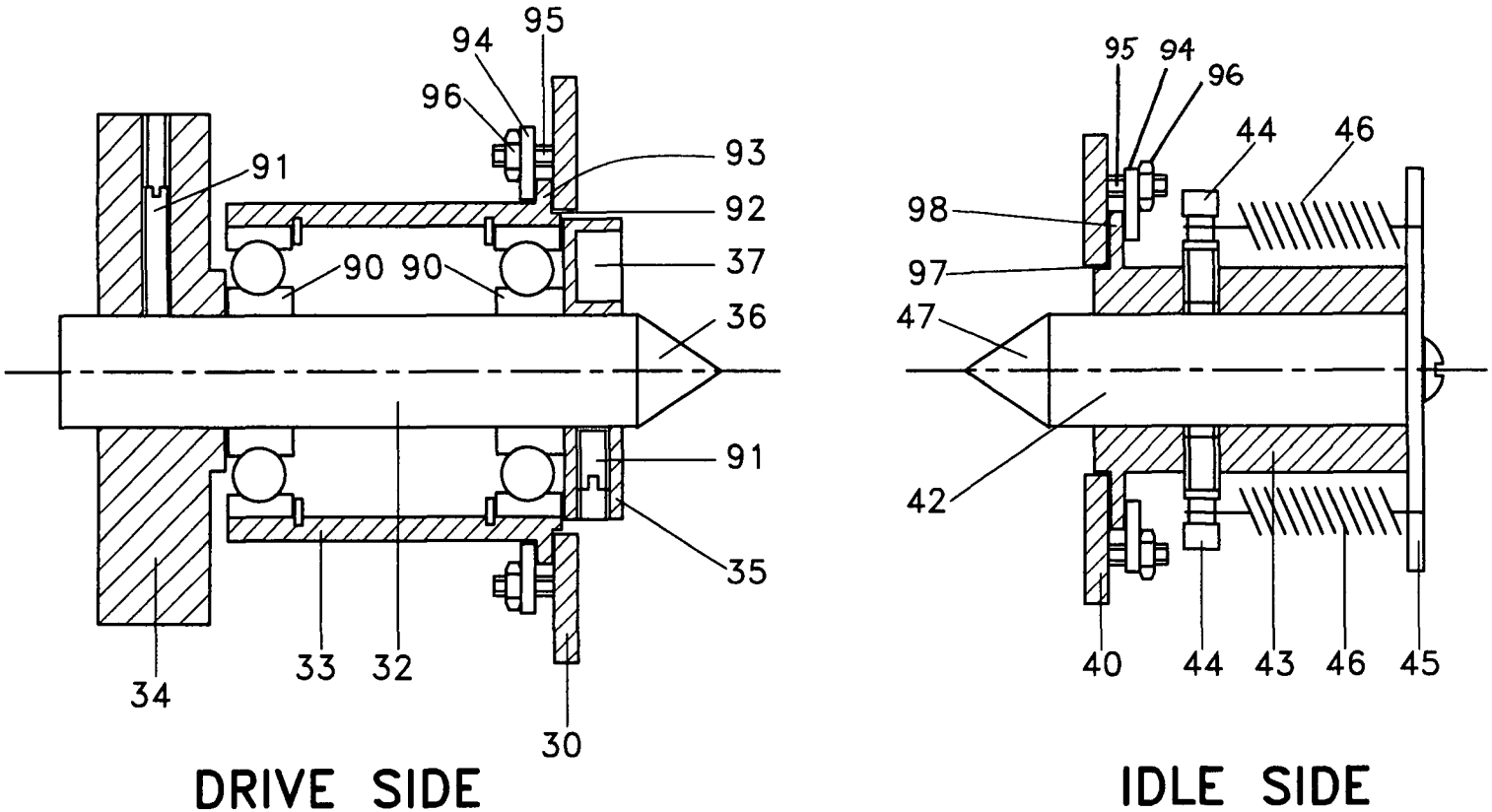
FIG. 4 is a section view of a bearing arrangement for a single roll.

FIG. 4 shows the construction of the drive side and idle side bearing assemblies in greater detail. On the drive side, the bearing housing 33 has a pair of ball bearings 90 that are axially fixed, each bearing having an outer race against the housing 33 and an inner race against the drive shaft 32. The housing 33 is machined with a flange 93 that is held against plate 30 by a pair of diametrically opposed fixing plates 94 secured by nuts 96 on studs 95. The inner end of the bearing housing 33 is machined to fit closely in hole 92 in the plate 30. The outer end of the drive shaft 32 is fitted with a pulley 34 that is fixed by set screw 91. The inner end of the drive shaft 32 is fitted with a round drive plate 35 that is also fixed by a set screw 91. The drive plate 35 is provided with a recess or slot 37 that receives drive pin 23 to prevent relative rotation. The plate 35 is dimensioned to rotate freely within hole 92 in the plate 30.

On the idle side, the sleeve 43 is machined with a flange 98 held against the plate 40 by a pair of diametrically opposed fixing plates 94 secured by nuts 96 on studs 95. The inner end of the sleeve 43 is machined to fit closely in hole 97 in the plate 40. Since the associated roll has been removed, the conical tip 47 is fully extended beyond the plate 40, and spring plate 45 bears against the sleeve 43 under the action of springs 46.

Figure 5:
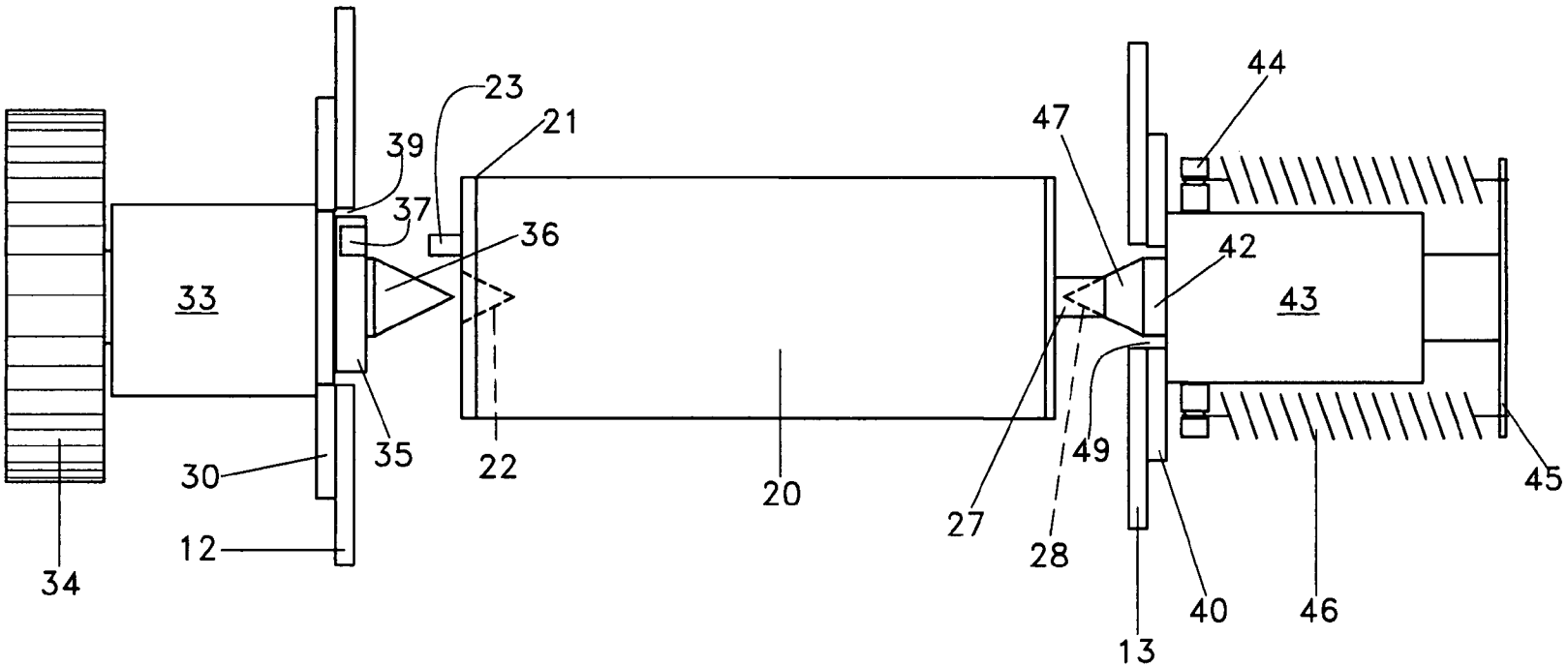
FIG. 5 is a schematic view showing the first step for removing a roll.

FIG. 5 shows the roll 20 moved against the action of springs 46 so that the cone 36 disengages the central recess 22 in the first end 21, and the drive pin 23 disengages the recess 37 in drive plate 35. From this position the first end 21 can be pivoted upward until it clears the first chassis plate 12, then moved axially until the cone 47 disengages the recess 28 in spigot 27. The spring plate 45 will then be against the sleeve 43, as shown in FIG. 4.

FIG. 5 shows the roll 34 moved against the action of springs 46 so that the cone 36 disengages the central recess 22 in the first end 21, and the drive pin 23 disengages the recess 37 in drive plate 35. From this position the first end 21 can be pivoted upward until it clears the first chassis plate 30, then moved axially until the cone 47 disengages the recess 28 in spigot 27. The spring plate 45 will then be against the slide housing 43.

FIG. 6 shows the drive arrangement and gap adjustment mechanism. The motor shaft 17 is fitted with a motor pulley 18 that turns speed reduction pulley 61 via a primary drive belt 60. The pulley 61 is mounted coaxially with drive pulley 62 on shaft 63, which is also visible in FIG. 2. The drive pulley 62 turns the feed pulley 34, center pulley 34', and apron pulley 34" via roller drive belt 64. As can be seen from the relative pulley sizes, this results in a large reduction in RPM from the motor to the rolls. The motor operates at speeds up to 4500 RPM, while the apron roll turns at speeds up to 420 RPM. All pulleys have teeth, and both belts 60, 64 are cog belts that positively engage the pulleys so there is no slippage. The motor pulley 18 and reduction pulley 61 have a first tooth spacing, whereas the drive pulley and roll have a second (larger) tooth spacing. The feed pulley 34 has 36 teeth, the center pulley 34' has 20 teeth, and the apron pulley 34" has 13 teeth. This results in relative speeds in a ratio of 1:1.80:2.77.

Tension is maintained on roll drive belt 64 by jockey pulley 65 journaled on the end of swing arm 66. This tension can be adjusted by pivoting the swing arm 66 about pivot pin 67, which is fixed in first chassis plate 12. The swing arm 66 has a slot 69 for screw 68 that is used to lock the position of the swing arm.

Figure 7:
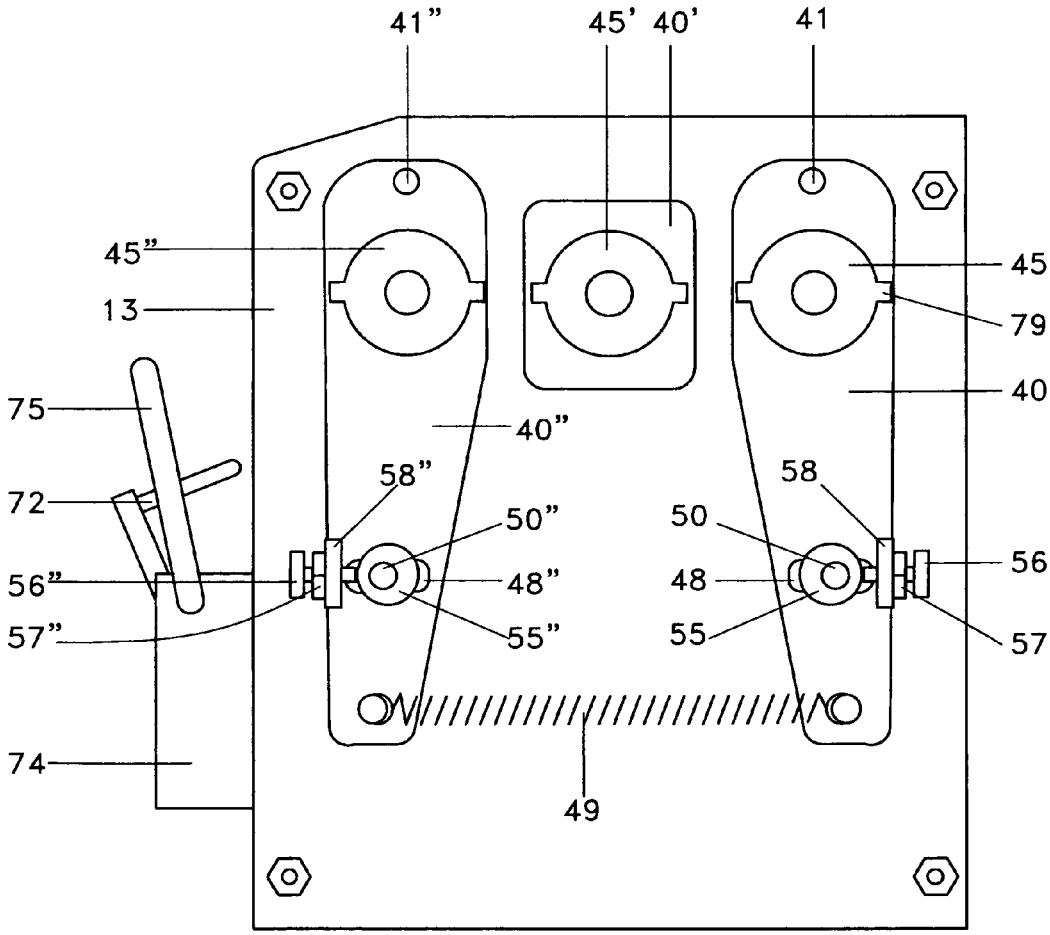
FIG. 7 is an end view showing the spring plates.

The drive shafts 32, 32" have axes that are fixed in respective pivot plates 30, 30". The plates 30, 30" can pivot about pins 31, 31" fixed in first chassis plate 12. The first chassis plate 12 is provided with slots 39 (FIG. 5) that accommodate lateral movement of the drive plates 35, 35". The center drive shaft 32' is carried in fixed plate 30' and cannot be moved laterally. Referring to FIG. 7, a mirror image arrangement is provided on second chassis plate 13, where the pivot plates 40, 40" can pivot about fixed pins 41, 41". The second chassis plate 13 is provided with slots 49 (FIG. 5) that accommodate lateral movement of the pins 42, 42" (FIG. 2, FIG. 5).

The gap 29 between rolls 20, 20' is adjusted by rotating camshaft 50 that is journaled for rotation in chassis plates 12, 13 and passes through slots 38, 48 in respective pivot plates 30, 40. The camshaft 50 carries a cam 51 that contacts a cam follower 52 in the form of a thumbscrew received through a block 54 fixed to pivot plate 30. The camshaft 50 carries another cam 55 that contacts a similar cam follower 56 mounted on opposing pivot plate 40. Rotating the camshaft 50 causes the plates 30, 40 to pivot due to eccentricity of the cams. Fine calibration is achieved by turning the thumbscrews 52, 56, which can be locked by turning nuts 53, 57 against blocks 54, 58.

The gap 29' between rolls 20', 20" is adjusted by rotating camshaft 50" that is journaled for rotation in chassis plates 12, 13 and passes through slots 38", 48" in respective pivot plates 30", 40". The camshaft 50" carries a cam 51" that contacts one end of a rocker arm 89 whose other end contacts a cam follower 52" in the form of a thumbscrew received through a block 54" fixed to pivot plate 40". This is similar to the arrangement on pivot plate 30, but for the interposition of rocker arm 89 mounted on the pivot plate 30", which is necessary to make room for the control panel 80. The camshaft 50" carries another cam 55" that contacts a cam follower 56" mounted on the opposing plate 40", as shown in FIG. 7. Rotating the camshaft 50" causes the plates 30", 40" to pivot due to eccentricity of cams 51", 55". Fine calibration is achieved by turning the thumbscrews 52", 56", which can then be locked by turning nuts 53", 57" against blocks 54", 58" on the respective pivot plates 30", 40".

The presence of cams and a calibration mechanism at both ends of each roll 20, 20" assures that the gaps 29, 29' can be precisely controlled and made uniform along their length. The pivot plates 30, 30" are loaded toward each other by a tension spring 39, and the pivot plates 40, 40" are also loaded toward each other by a tension spring 49. The camshafts 50, 50" encounter enough friction that they will not turn without the use of knobs 59, 59". The gaps 29, 29' are typically in a range of 20 to 600 microns.

FIG. 8 is a schematic view of the scraper 70, which is mounted on locator pins 72 on a pivot block 71 which pivots about shaft 73 in support blocks 74 on the front of box frame 10. A lever 76 extending through an aperture in the frame is urged downward by a tension spring 77 fixed to a hanger 78 on the floor of the frame.

The foregoing is exemplary and not intended to limit the scope of the claims which follow.

What is claimed is:

1. A three roll mill comprising:

a frame comprising first and second spaced apart support structures;

a feed roll mounted for rotation between the first and second support structures;

a center roll mounted for rotation between the first and second support structures parallel to the feed roll, thereby forming a first nip between the center roll and the feed roll;

an apron roll mounted for rotation between the first and second support structures parallel to the center roll, thereby forming a second nip between the apron roll and the center roll;

wherein each said roll has a first end at said first support structure, a first mating profile at the first end, a second end at said second support structure, a second mating profile at the second end, an axis of rotation between said ends, and a cylindrical surface extending coaxially between said ends;

for each said roll, a first mating piece mounted for rotation in said first support structure and engaging said first mating profile to prevent relative rotation of said roll relative to said first mating piece, a second mating piece mounted for axial movement in said second support structure and engaging said second mating profile coaxially to permit rotation of said roll relative to said second support structure, at least one spring exerting a spring force loading the second mating piece toward the first support structure said first mating profile disengaging said first mating piece when said roll is moved axially away from said first support structure against said spring force, said second mating profile disengaging said second mating piece when said roll is moved transversely of said axis after disengaging said first mating profile from said first mating piece; and means for applying torque to said rolls so that said cylindrical surfaces move in the same direction but different speeds in each said nip, said cylindrical surface of said center roll moving faster than said cylindrical surface of said feed roll, said cylindrical surface of said apron roll moving faster than said cylindrical surface of said center roll;

wherein said means for applying torque comprises rotational linkage arranged on said first support structure so that said first ends are driven in rotation, said second ends being arranged to rotate freely at said second support structure.

2. The three roll mill of claim 1 wherein said rotational linkage comprises three roll pulleys arranged coaxially with respective said rolls, and at least one drive belt rotationally linking said roll pulleys.

3. The three roll mill of claim 2 wherein said rotational linkage further comprises a drive pulley rotationally connected to at least one of said roll pulleys.

4. The three roll mill of claim 3 wherein a single drive belt rotationally connects said drive pulley and said roll pulleys.

5. The three roll mill of claim 3 wherein said means for applying torque further comprises a motor mounted between said support structures, a motor pulley arranged on said first support structure and driven by said motor, a reduction pulley arranged coaxially and fixed with respect to said drive pulley, and a drive belt rotationally linking said motor pulley to said reduction pulley.

6. The three roll mill of claim 2 wherein said cylindrical surfaces have the same diameter and said roll pulleys have different diameters.

7. The three roll mill of claim 1 wherein each said first mating piece comprises a drive plate facing the first mating profile of a respective said roll, said drive plate comprising one of a central recess and a central protrusion, said mating profile comprising the other of a central recess and a central protrusion, wherein said central protrusion is received in said central recess to center said mating piece coaxially with respect to said roll, said drive plate further comprising one of a radially offset recess and a radially offset protrusion, said mating profile comprising the other of a radially offset recess and a radially offset protrusion, wherein said offset protrusion is received in said offset recess to prevent rotation of said first mating piece with respect to said roll.

8. The three roll mill of claim 7 wherein said central protrusion is located on said drive plate.

9. The three roll mill of claim 7 wherein said central recess is a conical recess, and said central protrusion is a cone.

10. The three roll mill of claim 7 wherein said offset recess is located in said drive plate.

11. The three roll mill of claim 1 wherein each said second mating profile can rotate relative to the respective said second mating piece.

12. The three roll mill of claim 11 wherein said second mating piece comprises one of a central protrusion and a central recess, and said second mating profile comprises the other of a central protrusion and a central recess.

13. The three roll mill of claim 12 wherein said central recess is a conical recess, and said central protrusion is a cone.

14. The three roll mill of claim 1 wherein each said support structure comprises a chassis plate and a pair of pivot plates pivotably mounted thereon, the axis of rotation of said feed roll being fixed with respect to one of said pivot plates on each of said chassis plates, the axis of rotation of said apron roll being fixed with respect to the other of said pivot plates on each of said chassis plates, whereby the nips can be adjusted by pivoting the pivot plates.

15. The three roll mill of claim 14 further comprising a pair of camshafts journaled for rotation in said chassis plates and passing through said pivot plates, each said camshaft carrying a pair of cams adjacent to respective said pivot plates, each said pivot plate carrying an adjustable cam follower which bears against a respective one of said cams so that the pivot plates can be pivoted to adjust the nips.

16. A three roll mill comprising:

a frame comprising first and second spaced apart support structures;

a feed roll, a center roll, and an apron roll mounted for rotation between the first and second support structures, the rolls being mounted in parallel to form a first nip between the center roll and the feed roll, and a second nip between the apron roll and the center roll, each said roll having a first end at said first support structure, a second end at said second support structure, an axis of rotation between said ends, and a cylindrical surface extending coaxially between said ends;

means for applying torque to said rolls so that said cylindrical surfaces move in the same direction but different speeds in each said nip, said cylindrical surface of said center roll moving faster than said cylindrical surface of said feed roll, said cylindrical surface of said apron roll moving faster than said cylindrical surface of said center roll, said means for applying torque comprising rotational linkage arranged on said first support structure so that said first ends are driven in rotation, said second ends being arranged to rotate freely at said second support structure;

each said roll being movable axially toward said second support structure against a spring force so that said first end is disengaged from said rotational linkage, whereupon said roll may be removed from the frame by moving said roll transversely of its axis.

17. The three roll mill of claim 16 wherein each said support structure comprises a chassis plate and a pair of pivot plates pivotably mounted thereon, the axis of rotation of said feed roll being fixed with respect to one of said pivot plates on each of said chassis plates, the axis of rotation of said apron roll being fixed with respect to the other of said pivot plates on each of said chassis plates, whereby the nips can be adjusted by pivoting the pivot plates.

18. The three roll mill of claim 17 further comprising a pair of camshafts journaled for rotation in said chassis plates and passing through said pivot plates, each said camshaft carrying a pair of cams adjacent to respective said pivot plates, each said pivot plate carrying an adjustable cam follower which bears against a respective one of said cams so that the pivot plates can be pivoted to adjust the nips.

* * * * *